United States Patent [19]

Ciancimino

[11] Patent Number: 4,473,170

[45] Date of Patent: Sep. 25, 1984

[54] GARBAGE PAIL AND LID ARRANGEMENT

[76] Inventor: Jack J. Ciancimino, 6 Medford Rd., Sound Beach, N.Y. 11786

[21] Appl. No.: 520,657

[22] Filed: Aug. 5, 1983

[51] Int. Cl.[3] ..... B65D 41/06; B65D 41/36

[52] U.S. Cl. ..... 220/300; 220/293; 220/1 T

[58] Field of Search ..... 220/1 T, 293, 298, 300, 220/301, 302, 314, 375

[56] References Cited

U.S. PATENT DOCUMENTS 2,661,974 12/1953 Zehnder ..... 220/314

4,279,355 7/1981 Schwartz et al. ..... 220/300

*Primary Examiner*—George T. Hall

*Attorney, Agent, or Firm*—Leonard Belkin

[57] ABSTRACT

A garbage pail and lid arrangement in which the lid is threaded into engagement with the pail and a cable is employed to secure the lid to the pail. A swivelly mounted eye bolt on the lid through which the cable passes permits the lid to be rotated freely. A special handle on the side of the pail opposite its center of gravity when filled permits the pail and lid to be carried conveniently by one hand.

8 Claims, 6 Drawing Figures

FIG. 1
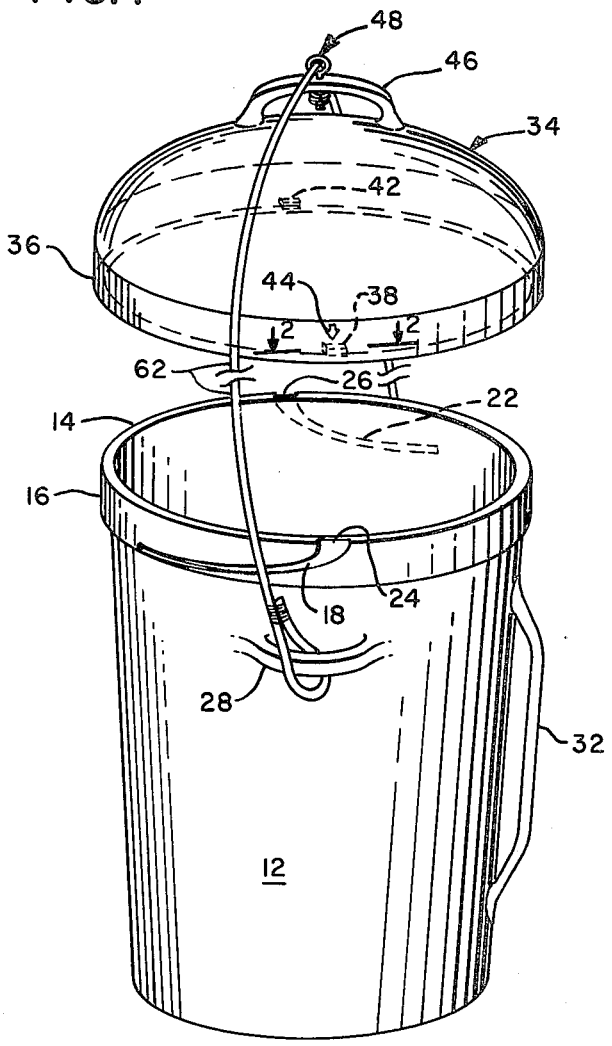
FIG. 2
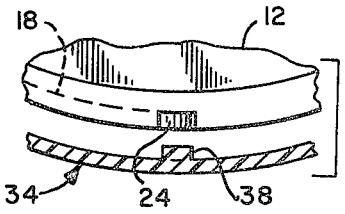
FIG. 6
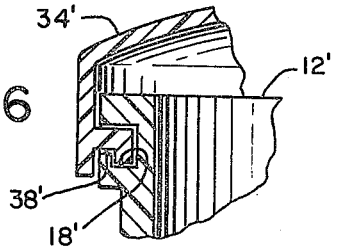
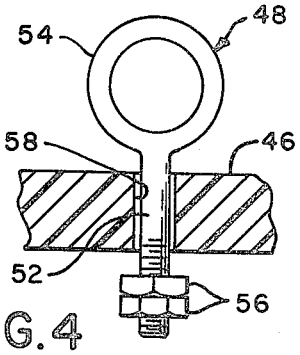
FIG. 4
FIG. 3
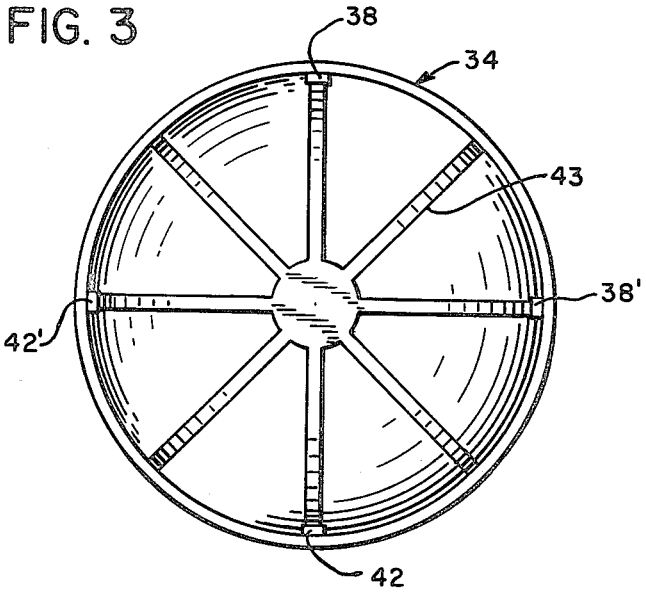
FIG. 5
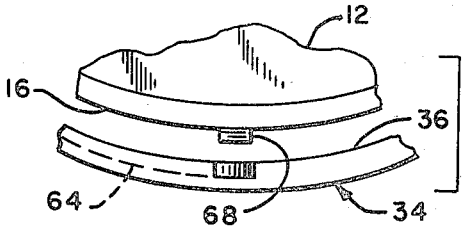

GARBAGE PAIL AND LID ARRANGEMENT

BACKGROUND OF THE INVENTION

This invention relates to a garbage pail and lid arrangement and more particularly to a garbage pail and lid arrangement incorporating a variety of convenience and security features.

Garbage pails currently available for use, plastic or metal, utilize covers or lids which are fitted to the top opening, relying on friction to hold them in place. A variety of problems arise as a result of this construction. If the fit is very tight it becomes annoyingly difficult to put the lid in place or to remove it. Where the fit is loose, as is usually the case because of the relatively inexpensive construction and the need to have interchangeability of lids and pails, the filled garbage pail is subject to being opened by roaming animals such as dogs and cats with the result that the garbage is frequently strewn over the street. In addition, when the lid becomes separated from the pail, the former may not be recovered so that the pail is left without a cover.

Efforts to combat these problems include the use of ropes, chains, and springs stretched through the handle on the lid and connected to the handles on the sides. These devices or arrangements are subject to a variety of drawbacks. If they are tightly drawn then it is difficult to remove or replace the lids. If they are connected loosely, then access to the garbage within the pails by animals remains as a problem. Springs designed to satisfy both of the requirements of ease of lid removal and replacement, and secure attachment, become stretched out with use and must frequently be replaced.

SUMMARY OF THE PRESENT INVENTION

The present invention overcomes or reduces many of the problems with present garbage pail and lid arrangements by providing for a construction in which the lid upon being rotated makes a positive connection to the pail and a permanent cable is provided which permits the lid to be securely attached and readily removed without being twisted or becoming entangled.

In accordance with the principles of this invention there is provided in a preferred embodiment an open top pail with two or more slots on the outside adjacent the top edge, each slot extending down from the edge and curved to extend circumferentially for some distance around the pail, the slots being on opposite sides of the pail. The lid for covering the top opening of the pail has a rim which extends down a short distance fully enclosing the top of the pail. On the underside of the rim are matching nodules arranged to engage and fit in the slots. When the lid is properly placed and rotated there will be positive engagement of the lid to the pail. The lid has also a handle centrally located on the top with a swivelled eye member mounted therein. A cable extends through the eye and its ends are attached to the sides of the pail. Thus the lid may be rotated for engagement or disengagement without twisting or entangling the cable.

The garbage pail and lid arrangement embodying the principles of this invention may embody other features and variations which render it very useful and convenient for the collection and storage of garbage.

It is thus a principal object of this invention to provide a garbage pail and lid arrangement having improved convenience and security characteristics.

Other objects and advantages of this invention will hereinafter become obvious from the following description of preferred embodiments of this invention.

BRIEF DESCRIPTION OF THE FIGURES

FIG. 1 is an isometric, exploded view of a garbage pail and lid embodying the principles of this invention.

FIG. 2 is a view along 2—2 of FIG. 1 with the lid just covering the pail.

FIG. 3 is a view of the lid from underneath employing four nodules.

FIG. 4 is a detail in section of a portion of the handle.

FIG. 5 is a view similar to that of FIG. 2 with an alternative construction of the nodule and slot arrangement.

FIG. 6 is a detail in section of an alternative nodule construction.

DESCRIPTION OF THE PREFERRED EMBODIMENTS

Referring to FIGS. 1 and 2, pail 12 is circular in cross section and may be of constant or variable diameter along its length as illustrated. The upper end of pail 12 terminates in an edge 14 forming the opening with rim 16 of constant diameter. A pair of identical slots 18 and 22 with entries 24 and 26, respectively, are at the upper edge 14. It will be seen that slots 18 and 22 are oversize at the entrance and curve away and taper down in width from their respective entries 24 and 26 and generally are directed circumferentially for some appropriate distance on the outer surface of rim 16. The extent of slots 18 and 22 is not critical and typically might cover about 45 degrees over the circumference.

Pail 12 would be provided with a pair of conventional handles on the side, only one of which, designated by numeral 28, can be seen. Another handle 32 is located on the side of pail 12 and centered over the center of gravity of the pail when tipped so that the pail with lid filled with trash or garbage can conveniently be carried by one hand. Handle 32 may be an integral part of pail 12, for example, and if the latter is made of molded plastic, handle 32 can be part of the pail itself. On the other hand, for ease of packing and shipping handle 32 may be detachable using bolts or slots to engage it so that handle 32 can be separate from the pail and be assembled after purchase by the user.

Lid 34 can be of any convenient shape, spherical as illustrated, or flat, with a lip 36 of uniform diameter and whose inside diameter is sufficiently large so that lid 34 will completely enclose the top of pail 12. That is, the width of lip 36 should be at least as great as the width of rim 16. Mounted on the inside of lip 36 are a pair of oppositely facing nodules 38 and 42, which when lid 34 is placed on pail 12, it is possible to align said nodules 38 and 42 to enter slots 18 and 22. An arrow or index mark 44 can be utilized to indicate the location of one of the nodules to facilitate the entry of the latter into the aforesaid slots. Index mark 44 may, if desired, be aligned with handle 46 for convenience. After nodules 38 and 42 enter slots 18 and 22, respectively, rotation of lid 34 clockwise will in effect lock the latter to pail 12. The inside diameter of lid 34 is sufficiently oversized as to render it easy and convenient to be rotated without any binding to take place, and nodules 38 and 42 are sufficiently large in height as to insure that they will remain within their respective slots. It is understood that instead of two nodules, any suitable number such as three or four equispaced nodules with associated slots may be employed. In order to insure that lid 34 remains rigid and does not bend out of shape when pail 12 is carried by handle 32, a ribbed structure may be utilized as shown in FIG. 3 in which lid 34 is shown with four nodules 38, 38', 42, and 42', and a plurality of ribs 43 to render lid 34 less flexible.

In order to insure that lid 34 stays with pail 12 at all times, even when it is removed, a wire arrangement is provided. It will be seen that lid 34 has a handle 46. Through the latter is mounted an eye member 48, which as shown in greater detail in FIG. 4, consists of a bolt 52 terminating in a loop 54 at the top and a pair of nuts 56 at the bottom to insure that member 48 stays mounted as described, a portion of bolt 52 being threaded for this purpose. An oversized opening 58 through handle 46 insures that member 48 is free to rotate.

A cable 62 passes through loop 54 and the ends of the former are attached as shown to the handles, handle 28 being illustrated. It is understood that cable 62 may be attached anywhere on pail 12 where it may be convenient and the attachment may be in any suitable manner. If the cable is metal in construction it may merely be looped and crimped as shown. Also, a plastic coating may be applied to the metal to maintain appearance, reduce corrosion, and minimize any possibility it could scrape the skin of a user.

The length of cable 62 should be just sufficient for lid 34 to be raised from pail 12 and be swung over to the side. The fit of lid 34 on pail 12 should be loose to render the whole arrangement convenient to use. It is evident also, that lid 34 can be freely rotated to lock it or to release it when desired. In any event, when locked in slots 18 and 22, tipping of pail 12 will not result in lid 34 coming off and releasing any of the trash or garbage contained therein. This can virtually be insured by making the slots run close to a full 45 degress on pail 12.

In the arrangement illustrated in FIGS. 1, 2, 3, and 4, the nodules which engage the slots are located on the lid. This construction can very well be reversed as indicated in FIG. 5 where it is seen that nodule 62 on rim 16 of pail 12 is just entering slot 64 on the inside of lip 36 of lid 34. As in the previously described arrangement, there would be one or more other nodules and slots on the opposite side of these parts of the pail assembly.

Under some circumstances it may be desirable to have a more positive connection between the nodules and their slots. As shown in FIG. 6, in pail 12' with lid 34' nodules 38' may be L-shaped to engage slot 18' having a lip for that purpose.

It will be seen that there has been provided an improved garbage pail and lid arrangement which overcomes or reduces many of the problems heretofore associated with devices of this type.

Many modifications and variations of this invention are possible without departing from the principles of this invention as defined in the claims which follow.

What is claimed is:

1. A garbage pail and lid arrangement in which said pail is of generally cylindrical construction having an open top, at least two slots formed in the outside of said pail adjacent the open top, each of said slots directed down from the top edge of said pail and curved to extend for some predetermined distance parallel to said top edge, said slots being equispaced on said pail, said lid fitting over said open top and having a rim extending down over the outside of said pail, a nodule on the inside of said rim arranged to engage each of said slots, whereby when said lid is placed on said pail with said nodules lined up with said slots rotation of said lid will cause said lid and pail to be engaged in a positive manner with each other, said lid having a handle centrally located on the outside of said lid, means swivelly mounted on said handle having an opening therethrough, and a cable extending through said opening and having its ends attached to the sides of said pail whereby said lid can be rotated to engage or disengage with or from said pail freely and without twisting said cable.

2. The arrangement of claim 1 in which said slots are formed on the inside of said lip of said lid and said nodules are located on the outside of said rim on said pail adjacent the upper edge thereof.

3. The arrangement of claim 1 having a handle on the side of said pail approximately opposite the center of gravity of said pail when filled with trash and garbage.

4. The arrangement of claim 3 in which the swivelly mounted means comprises an eye bolt passing through the handle on said lid.

5. The arrangement of claim 4 in which said pail has handles on opposite sides thereof to which said cable is attached.

6. The arrangement of claim 5 in which said lid is provided with ribs for reinforcement to prevent distortion as said pail is carried by the aforesaid handle on the side of said pail.

7. The arrangement of claim 6 in which the entrance of each of said slots is oversized to accommodate said nodules and the slots taper down in width so as to insure a tight fit of said lid on said pail as the former is rotated into engagement with said pail.

8. The arrangement of claim 7 in which said nodules are L-shaped and said slots are provided with lips to insure a more secure engagement between said nodules and slots.

* * * * *